United States Patent [19]

Small, Jr.

[11] 4,225,908

[45] Sep. 30, 1980

[54] LIGHTING FIXTURE AND GLASS ENCLOSURE HAVING HIGH ANGLE ANTI-REFLECTION FILM

[75] Inventor: Edward A. Small, Jr., Santa Rosa, Calif.

[73] Assignee: Optical Coating Laboratory, Inc., Santa Rosa, Calif.

[21] Appl. No.: 926,563

[22] Filed: Jul. 20, 1978

Related U.S. Application Data

[63] Continuation of Ser. No. 744,197, Nov. 22, 1976, abandoned.

[51] Int. Cl.[2] ..... F21V 9/00; H01J 5/16; B05D 3/04

[52] U.S. Cl. ..... 362/293; 313/112; 362/2; 362/256; 362/311; 362/351; 362/362; 427/309

[58] Field of Search ..... 362/2, 255, 257, 261, 362/263, 268, 293, 300, 301, 303, 305, 307, 317, 351, 355, 362, 1, 19, 256, 264, 311, 329; 427/307, 309; 313/112, 113, 116

[56] References Cited

U.S. PATENT DOCUMENTS 3,322,946 5/1967 Cooper ..... 362/293

OTHER PUBLICATIONS

Minot, "Journal of the Optical Society of America", vol. 66, No. 6, Jun. 1976, pp. 515–519.

*Primary Examiner*—Donald P. Walsh
*Attorney, Agent, or Firm*—Flehr, Hohbach, Test, Albritton & Herbert

[57] ABSTRACT

Lighting fixture having housing with an open side. A lamp is mounted in the housing and is capable of producing light rays which pass through the open side of the housing. A glass protective covering is carried by the housing and encloses the open side. At least one surface of the glass is provided with anti-reflection film formed by a chemical etch/leach process on the one surface. The anti-reflection film increases the transmission of the high angle light rays from the lamp.

1 Claim, 6 Drawing Figures

PERCENT AVERAGE VISUAL TRANSMITTANCE

| | 0° | 60° |
|---|---|---|
| NO LENS | 100% | 100% |
| 3/16" SODA LIME GLASS | 90.0% | 82.7% |
| 3/16" BOROSILICATE GLASS | 91.0% | 84.2% |
| 3/16" TREATED BOROSILICATE GLASS | 98.7% | 98.0% |

LIGHTING FIXTURE AND GLASS ENCLOSURE HAVING HIGH ANGLE ANTI-REFLECTION FILM

This is a continuation of application Ser. No. 744,197 filed Nov. 22, 1976, now abandoned.

BACKGROUND OF THE INVENTION

A lighting fixture and luminairs of many types heretofore have been provided which have housings which are open on one side and which have glass coverings for the open side. Because of high energy costs and also because of increased costs for lighting fixtures, poles for mounting the same and the like, there is a great need for increasing the efficiency of the lighting fixtures. As known the glass when used as a protective covering has a high reflection of light at relatively wide angles. Therefore there is a need to increase the efficiency of the lighting fixtures, particularly at high angles.

SUMMARY OF THE INVENTION AND OBJECTS

In general, the lighting fixture consists of a housing having an open side. A lamp is mounted in the housing and is capable of producing light rays passing through the open side of the housing. A glass enclosure carried by the housing and encloses the opening side and has first and second surfaces. At least one of the surfaces is formed of an anti-reflection film produced by a chemical etch/leach process at said one surface. The anti-reflection film increases the transmission of the high angle light rays from the lamp.

In general it is an object of the present invention to provide a lighting fixture which has an increased light output particularly at high angles.

Another object of the invention is to provide a lighting fixture of the above character and a glass enclosure therefore in which an anti-reflection film is formed on one of the surfaces by a chemical etch/leach process at the one surface.

Another object of the invention is to provide a lighting fixture and a glass enclosure therefore of the above character in which the film provided on the glass enclosure has a broad wave length band and which is effective in two polarization planes.

Another object of the invention is to provide a lighting fixture of the above character which will operate at cooler temperatures.

Another object of the invention is to provide a lighting fixture and a glass enclosure therefore in which the glass enclosure utilized has low optical absorption and is relatively insensitive to heat shock.

Another object of the invention is to provide a lighting fixture and a glass enclosure therefore of the above character in which the glass enclosure is formed of a glass which is relatively strong which need not be tempered in most applications.

Additional objects and features of the invention will appear from the following description in which the preferred embodiments have been set forth in conjunction with the accompanying drawings.

BRIEF DESCRIPTION OF PREFERRED EMBODIMENTS

Figure 1:
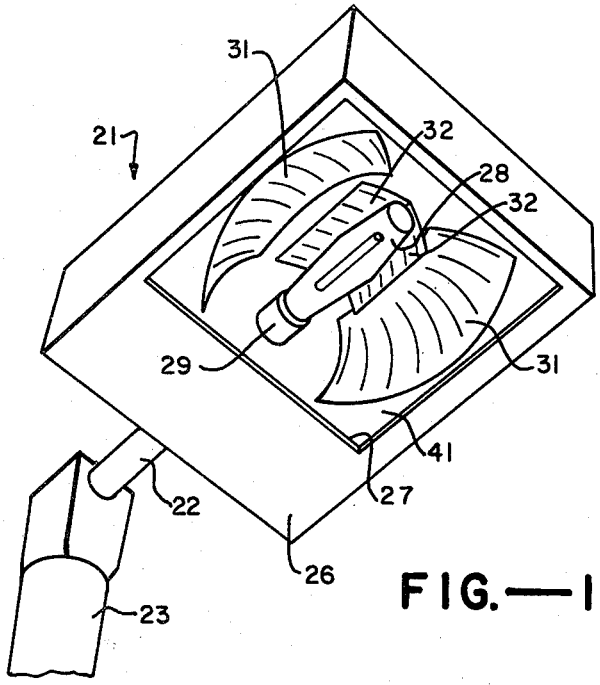
FIG. 1 is an isometric view of a lighting fixture incorporating the present invention.

FIGS. 1 through 4 are identical to those co-pending in application Ser. No. 709,413 filed on July 28, 1976. As described therein, in FIG. 1 there is shown a lighting fixture 21 carried by a horizontally extending rod 22. The rod is mounted upon a pole or standard 23 such as is commonly used in street or roadway lighting.

The lighting fixture 21 consists of a rectangular box-shaped housing 26 which is provided with a large downwardly facing rectangular opening 27. A light source is provided with the housing for directing rays of light through the opening and consists of a lamp 28 mounted in a socket 29. The socket 29 is mounted in the biasing 26 in a conventional manner. The lamps 28 is a conventional high intensity discharge-type (HID), typically a metal halide or high pressure sodium light source. Occasionally, a mercury lamp may be utilized. As shown in the drawing, the lamp 28 is a high pressure sodium light.

Reflective means is conventionally provided within the housing 26 to reflect additional light from the lamp 28 through the opening 27. As shown in FIG. 1, this reflective means consists of two pairs or sets of reflectors 31 and 32. The reflector 31 are side reflectors and are used for reflecting the light out of the opening and reflect the light at the high angle as indicated by the rays 33. The reflector 31 can have any desired shape. Typically they are curved and are often parabolic or hyperbolic to obtain the best light distribution. Reflectors 32 are conventionally smaller reflectors and are positioned over the lamp so that the rays eminating from the lamp in an upward direction are directed down through the opening 27 in the housing with some of the reflected rays passing through the lamp 28. These light rays pass out of the housing 26 at a relatively low angle as indicated by the rays 34. In addition to the rays which are reflected by the reflectors 31 and 32, there are also direct rays 36 which pass downwardly through the opening 27.

An enclosure in the form of a plate glass plate 41 is provided to close the opening 27 and is mounted in the housing in such a way so that it forms a sealed enclosure for the lamp 28. The glass plate is provided with spaced apart parallel planar surfaces 42 and 43 with 42 being the inside surface and 43 being the outside surface.

Figure 3:
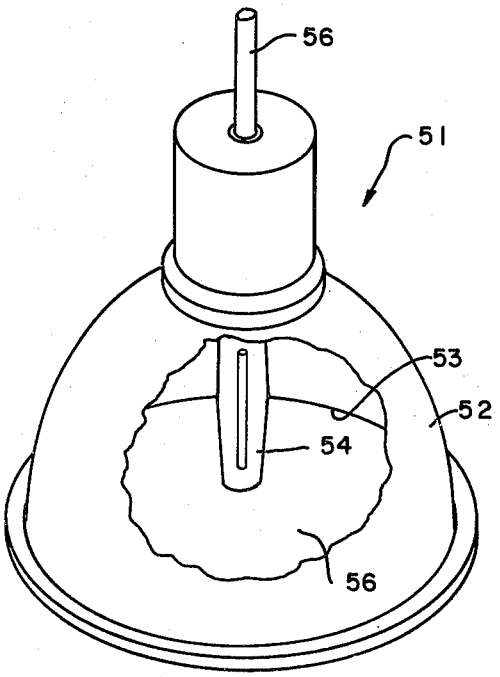
FIG. 3 is an isometric view of certain portions broken away of another type of lighting fixture incorporating the present invention.
Figure 4:
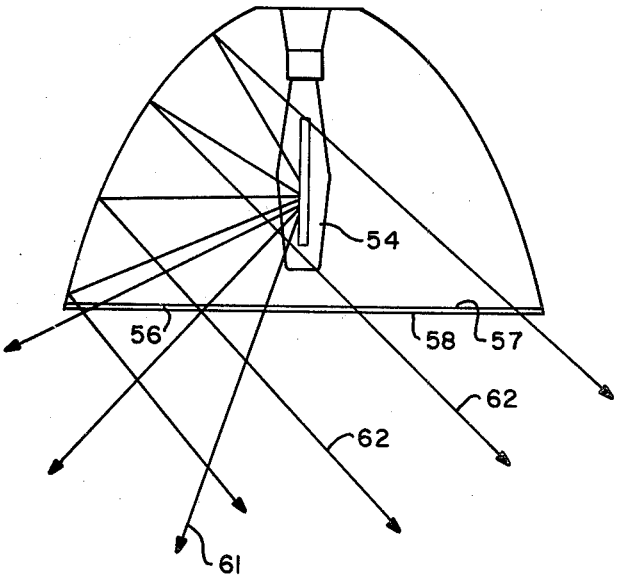
FIG. 4 is a diagrammatic illustration of the lighting fixture shown in FIG. 3.

In FIG. 3 there is shown another lighting fixture 51 of an industrial type. As shown therein, it includes a generally hemi-spheric housing 52 which also has a circular open end which defines a downwardly facing opening 53. A lamp 54 of the same type as lamp 28 shown in FIG. 1 is mounted in a socket (not shown) provided in the housing 52. The socket 52 is connected by a power cord 55 to a source of electrical power. A glass enclosure 56 is provided for closing opening 53. As shown, particularly in FIG. 4, the glass enclosure 56 is in the form of a plate which has spaced apart parallel planar inner and outer surfaces 57 and 58. The housing 52 serves as a reflector and in this type of lighting fixture provides a relatively uniform distribution of light below the housing 52 up to an angle of approximately 70°. As can be seen from FIG. 4, there are direct rays 61 emanating from the lamp 54 in addition, there are reflected rays 62.

Figure 2:
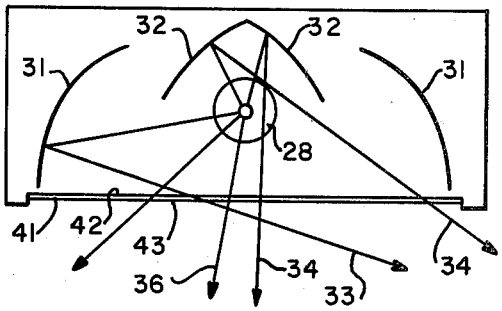
FIG. 2 is a diagrammatic illustration of the light fixture shown in FIG. 1.

In accordance with the present invention, the glass plates 41 and 56 which are utilized for enclosing the open sides of the fixtures shown in FIGS. 1 and 2 is formed with an anti-reflection film at one surface produced by a chemical etch/leach process at said one surface. The anti-reflection film increases the transmission of the high angle light rays from the lamp in the fixture.

In order to utilize the etch/leach process it is necessary that the glass be of a type which can be phase separated. One form of glass in sheet from which is available is a borosilicate glass sold as Pyrex by Corning Glass Works and Tempax sold by Schott Glass of Germany. The use of a borosilicate glass is advantageous in the present application for reasons other than its phase separation capabilities. The principal additional advantage is that since it is relatively free of iron, it is therefore low in optical absorption as herein after pointed out. Secondly, it is insensitive to heat shock. In addition, it has relatively great physical strength so that in most application in light fixtures it should not have to be tempered.

The formation of the anti-reflection film on the surface of the glass by the chemical etch/leach process at the one surface is described in an article by Michael J. Minot of the Research and Development Laboratories of Corning Glass Works, Corning, New York entitled "Single-Layer, Gradiant Refractive Index and Reflection Films Effective from 0.35 to 2.5 Microns" published in the Journal of the Optical Society of America, Volume 66, No. 6 in June, 1976 pages 515 through 519. As pointed out therein the durable interference film is produced by a chemical etch/leach process at the glass surface to reduce reflections. The anti-reflection film consists of a single porous skeletal layer made up largely of silica produced by an etch/leach process applied to phase separated glasses.

The phenomena of phase separation in alkali borosilicates is well known to those skilled in the art. These are glasses that are characterized by a miscibility temperature below which there is tendency for the glass components to separate into distinct phases. Under appropriate heat treatment conditions conducted below the miscibility temperature, the akali-borosilicates separate into a relatively insoluble silica-rich phase and into a soluble low-silica-content phase. This soluble phase can be readily dissolved by a variety of materials, including most mineral acids, leaving the high-silica-content phase as a porous skeletonized surface film. Due to the porous nature and the small size of the pores (radius less than 40 A°) the films exhibit an effective refractive index considerably lower than would be expected for a condensed film of silica.

As pointed out in the article, the films were formed by use of a Corning glass code 7440 glass heat treated for 3 hours at a temperature between 600° and 660° C. and then allowed to cool to room temperature. Following the heat treatment, the glass was given a skin removing etch. The glass was then rinsed in distilled water and subjected to the film forming etch/leach solution maintained at a temperature range 45° to 80° C. for the required film forming time which can vary from ½ to 35 minutes. Upon withdrawal, the film has been formed and the glass is ready for use.

It can be seen that with sheet glass, both the exposed surfaces can have films formed thereon, or if desired, a protective coating can be provided on one surface so that only one surface as the film formed thereon.

Figures 5, 6:
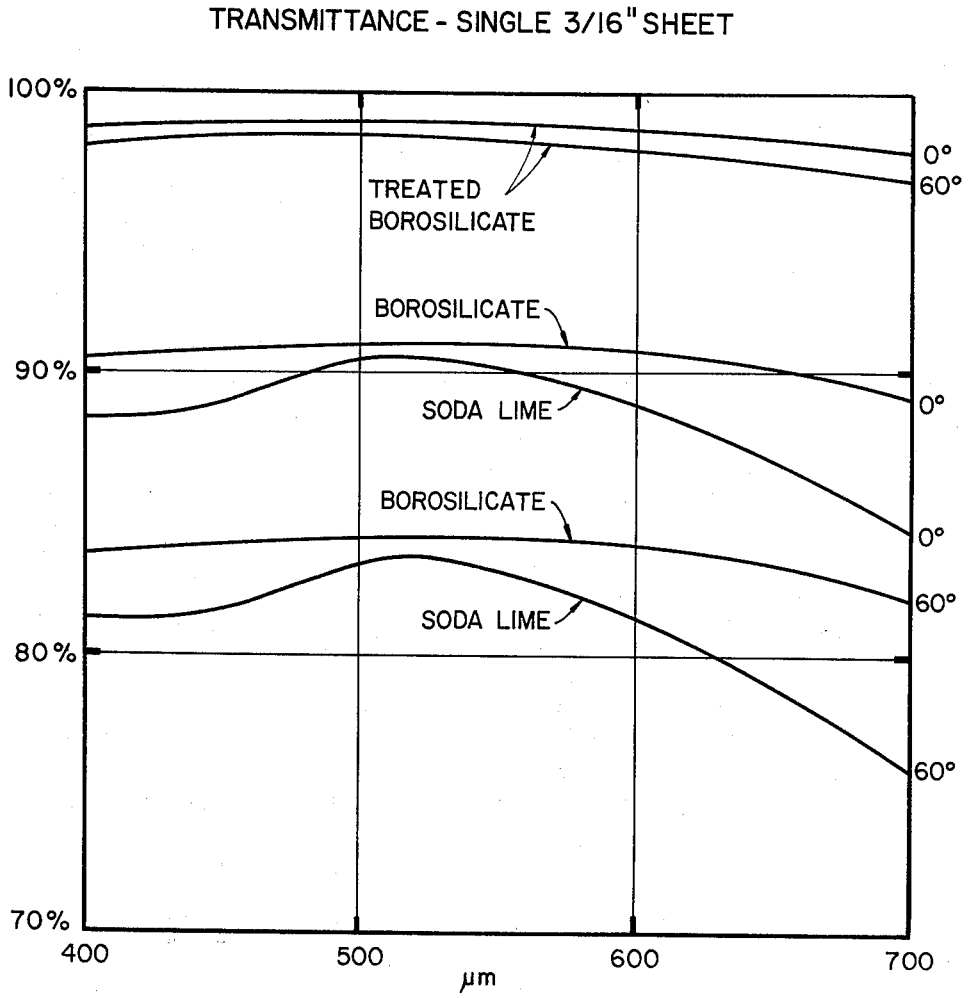
FIG. 5 shows transmittance of curves for various types of glass at different angles including a glass incorporating the present invention and utilized for a glass enclosure for a lighting fixture. The region of interest is from 400 to 7000 nanometers.
FIG. 6 shows a chart of average visual transmittance.

In FIG. 5, there is shown the transmittance curves for various types of glass in sheet form having a thickness of 3/16 of an inch for light at 0° and at 60° incidence. The 60° angle has been chosen because it is the most important angle at which to reduce reflection. Lighting fixtures of the type illustrated in FIGS. 1 and 2 are normally designed so that they will cut off light at angles above 70°. The sodalime glass utilized for the curves in FIG. 5 was tempered glass whereas the silicate glass was untempered. As can be seen from FIG. 5, the borosilicate glass which is provided with anti-reflection films on both surfaces in the manner hereinbefore described for utilization in the lighting fixtures has a transmissivity of 98% for high angle light rays at 60° and 98.7% for normal light rays or light rays having incidence of approximately 0°. In addition, it can be seen that the transmittance is a very broad band and covers the principal region of interest from 400 to 700 nanometers and drops off only very slightly in the region from 600 to 700 nanometers.

In FIG. 6 there is shown a chart which sets forth the average visual transmittance for the various types of glass. As can be seen from the chart, the transmittance for the treated borosilicate glass was 98.7% at 0° and 98.0% at 60°. From the chart it can be seen that at 60° the treated borosilicate glass gave a 16.5% increase in the light transmitted over the tempered sodalime glass.

Therefore it can be seen that the glass which is provided with the anti-reflection film has excellent light transmitting properties at high angles, in addition, the glass enclosure has low optical absorption because it is low in iron. In addition, it is relatively insensitive to the heat shock and is quite strong.

In addition to the broad wave length band in which the reflection films are effective, the films are also effective for two polarization planes. The broad wave band effectiveness makes it possible for the fixture to run at cooler temperatures because the anti-reflection film also works in the infra red area. The capabilities of the film as being effective in two polarization planes results in high transmittance at all angles.

It is apparent from the foregoing that there has been provided a lighting fixture and an enclosure therefor which is very effective in providing additional light at high angles with a transmissibility of better than approximately 98%. The enclosure which is provided is relatively insensitive to heat shock and in addition has good physical strength so that it need not be tempered for most applications.

I claim:

1. In a lighting fixture, a housing having an open side, a lamp mounted in said housing and producing light rays passing through the open side, a glass enclosure carried by said housing and enclosing the open side and having first and second surfaces, at least one of said surfaces being formed of an anti-reflection film produced by a chemical etch/leach process which is porous and skeletonized and has a high silica content said film having a tansmittance of better than approximately 98% for light incident and at an angle of approximately 60°; for the wave band of approximately 400 to 700 nanometers.

* * * * *